United States Patent [19]

Holmes

[11] Patent Number: 4,892,595

[45] Date of Patent: Jan. 9, 1990

[54] METHOD OF FORMING HIGH QUALITY MOLD PIN INSERT

[76] Inventor: Orie E. Holmes, 18997 Barroso St., Rowland Heights, Calif. 91748

[21] Appl. No.: 858,213

[22] Filed: Apr. 30, 1986

[51] Int. Cl.[4] ..... C21D 8/00

[52] U.S. Cl. ..... 148/12 R; 148/12.4; 264/2.5; 428/581; 351/177

[58] Field of Search ..... 29/527.6, 527.7; 264/2.5; 351/177, 160 R; 148/12.4, 12 R, 144, 902; 428/577, 581, 611; 164/303, 306, 312

[56] References Cited

U.S. PATENT DOCUMENTS 4,030,944 6/1977 Sommer et al. ..... 148/12.4

*Primary Examiner*—L. Dewayne Rutledge
*Assistant Examiner*—George Wyszomierski
*Attorney, Agent, or Firm*—Boniard I. Brown

[57] ABSTRACT

A mold pin insert for a high quality mold such as an optical quality injection mold for molding intraocular lenses, contact lenses and the like, is fabricated from a high quality rolled steel rod whose impurities are concentrated within a longitudinally extending central region of the rod surrounded by an annular relatively impurity free region. A slug is cut from this relatively impurity free annular region and is then heat treated to the desired hardness and machined and polished to the desired outside diameter to form the pin body. Finally, one end face of the slug is turned to form a mold face of desired shape or contour and to reorient the grains at the face in a circular direction about the longitudinal axes of the body, preferably using a cutting tool which produces a built-up edge before the tool, and the face is polished to finish the pin.

13 Claims, 2 Drawing Sheets

METHOD OF FORMING HIGH QUALITY MOLD PIN INSERT

BACKGROUND OF THE INVENTION

1. Field of the Invention:

This invention relates generally to the injection molding art and more particularly to a new and improved method of making a mold pin insert for a high quality, such as optical quality, injection mold for molding high or optical quality parts.

2. Discussion of the Prior Art:

As will become readily evident as the description proceeds, the principles of the invention may be utilized to make pin inserts for various types of molds. The invention, however, is particularly adapted to making mold pin inserts for optical quality molds of the kind which are employed to mold intraocular lenses, contact lenses and the like. For this reason, the invention will be described in the context of such use.

A typical optical quality mold for molding optical lenses, such as intraocular lenses and contact lenses, comprises a pair of mold plates to be mounted on the confronting sides of the platten and base of an injection molding machine. Positioned within these plates, on a common axis normal to the plates, are a pair of tubular mold inserts having external shoulders which position the inserts axially within the plates with their adjacent inner ends flush with the confronting parting faces of the plates. Removably fitted within the inserts are mold insert pins and insert bases between and in seating contact with the mold plates and the outer ends of the pins. The inner ends of these pins are flush with the inner ends of the mold inserts and the parting faces of the mold plates.

The inner end faces of the mold insert pins abut one another and are shaped to define a mold cavity when the die plates are closed. For molding a plano-convex lens, the inner end face of the lower mold pin is flat and normal to the pin axis. The inner end face of the upper pin forms a concave recess. When the die plates are closed, these faces together form a plano-convex mold cavity. Obviously, the pin faces may be shaped to form other types of mold cavities. The plastic to be molded enters the cavity thru an injection sprue in the mold plates.

The present invention is concerned with improving the mold insert pins and, to this end, provides an improved method for making these pins. According to the existing pin fabricating methods of which I am aware, mold insert pins are made from rolled steel rods whose diameter is just slightly larger than the desired outside diameter of the finished pins. Each rod is then ground or otherwise machined to the finished size. The initial rod diameter is selected to be only slightly larger than the finished pin diameter for reasons of machining economy, i.e., to minimize the machining time and the material lost in the machining operation.

The machined rod is then commonly sent out to a commercial heat treatment facility without specifying any particular heat treatment program. In many cases, the commercial heat treatments involve cryogenic freezing of the workpiece in the heat treatment cycle.

The end mold surface is then formed on the heat treated pin. This surface is commonly formed utilizing an electric discharge machining operation or a lathe turning operation.

This existing mold insert pin fabrication technique has many disadvantages. Thus, as noted earlier, roll forming a steel rod, such as the rods from which the existing pins are made drives impurities in the rod toward the center of the rod. This creates within the rod a central region of high impurity concentration which is exposed at the end mold face of the finished pin. As a consequence of this and the method of polishing of the mold face after electrical discharge machining, the mold face has a relatively high concentration of pits which result in bumps or peaks and the like in the finished molded lens. These bumps or peaks, while relatively small, cause much eye irritation and create pits in the eye tissue which often result in eye infection. By way of example, the industry standard for optical quality mold insert pins is a minimum of 4 to 10 pits on each mold surface with a pit size up to 0.06 microns. By contrast, the present invention results in a maximum of 3 pits, and usually one or two pits, and a maximum pit size on the order of 0.006 microns.

The commercial heat treatment programs, while suitable for many purposes, usually result in large grain size with impurities between the grains. The cryogenic freezing steps which are often used in these programs and are accepted as routine procedures, aggravate the problem due to the molecular stress produced by such freezing.

As noted above, electric discharge machining of the pin mold face and the methods used thereafter polish the face together with the high impurity concentration region at the center of the region result in the formation of a relatively large number of relatively large pits in the face which create eye irritating and often damaging peaks in the finished molded lens. In this regard, electric discharge machining of the mold surface has been found to produce deep fracturing of the surface due to the lack of any effective heat treatment after machining. Lathe turning of the mold surface, on the other hand, is commonly performed in a way which yields a free cutting action specifically for the purpose of avoiding edge build up before the cutter which the present invention deliberately employs to reorient the grains circularly about the pin axis and smooth out the pits and pipes, as explained later. These disadvantages of the existing methods of forming the pin mold face are aggravated by the high impurity concentration region at the center of the pin exposed at the mold face since the impurities tend to be dislodged by the face forming operations, thereby creating pits in the face which must be removed by polishing.

The existing polishing procedures also create a problem, however. Thus, the customary industry procedure for polishing the pin mold face involves a lapping operation utilizing an aluminum or diamond dust paste. Because of the high concentration of impurities at the center of the face, the polishing operation often tears impurity particles from the face, thereby forming additional pits which must be removed by more polishing.

Because of these many disadvantages of the existing mold insert pin fabricating procedures, the pin discard rate is very high. At best, the procedures produce mold pins capable of producing somewhat undesirable molded lenses and the like. Accordingly, there is a definite need for an improved pin fabricating method.

SUMMARY OF THE INVENTION

This invention provides such an improved pin fabricating method. The first step of the method is very unique and important and involves cutting a slug from the relatively low impurity concentration region of roll formed rod of high grade steel, such as STAVAX 420 ESR steel produced by the Uddeholm Corporation, to form a cylindrical blank, in effect, from which the pin is fabricated. In this regard, it was noted earlier that roll forming a steel rod drives impurities in the rod toward its center, thereby creating at the center a region of high impurity concentration surrounded by an annular region of relatively low impurity concentration. According to the present invention, the pin slug is formed from the annular region, as by coring the slug axially from the latter region. This slug, therefore, has a relatively small amount of impurities, substantially less, for example, than the existing mold insert pins which utilize the entire cross-section of the roll formed steel rod.

This pin slug is then heat treated, quenched, and thermally drawn in a draw oven, all while immersed in a corrosion resisting atmosphere, such as carbon dioxide. This heat treatment is programmed to first heat the slug to a point of dendritic crystal formation within the slug between nucleation and the onset of dendritic crystal growth, then quench the slug, and finally draw the slug in a draw oven and cool the slug to room temperature a number o times in succession to achieve the desired hardness of the slug.

The heat treated slug is then sized to a predetermined outside diameter, preferably by centerless grinding and then honing the slug. Thereafter, a mold face of desired contour (flat, convex, or concave) is formed on one end of the slug to complete the mold insert pin. This mold face is formed by a rotary cutting operation, such as by lathe turning, utilizing a cutting tool which produces a built-up edge before the cutter and thereby high cutter pressure against the face, all in such a manner as to reorient the grains at the mold face circularly about the axes of the pin and collapse pipes and pits on and in the face. If desired, the mold face may be further polished by utilizing a suitable lapping compound or by localized burnishing of the face.

The disclosed mold insert pin is for an optical quality mold for producing intraocular lenses, contact lenses, and the like. The present improved pin fabricating method produces a pin whose mold face has substantially fewer pits and substantially smaller pits than the existing method.

DESCRIPTION OF THE PREFERRED EMBODIMENT

Figure 1:
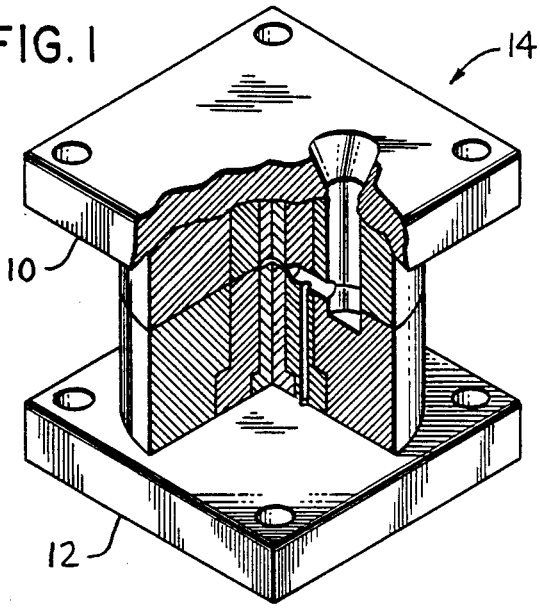
FIG. 1 is a cutaway perspective view of an optical quality mold embodying mold pins fabricated in accordance with the invention and mounted between the platten and base of an injection molding machine.
Figure 2:
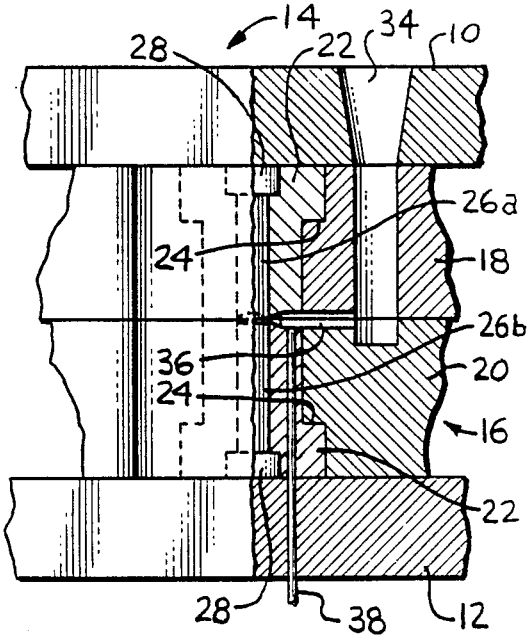
FIG. 2 is a fragmentary elevational view, partially in section, of a portion of the mold assembly of FIG. 1.

Referring first to the drawings, reference numerals 10 and 12 designate the platten and base, respectively, of an injection molding machine 14. Between the platten and base is an optical quality mold 16 for a lens, such as an intraocular lens or a contact lens. Mold 16 comprises two mold plates 18, 20 which are mounted by means (not shown) such as bolts, on the confronting sides of the platten 10 and base 12, respectively. Within the mold plates are coaxial tubular mold inserts 22 having external shoulders 24 which axially position the inserts with their adjacent inner ends flush with the confronting inner parting faces of the plates. Removably positioned within the inserts are mold pins 26*a*, 26*b*, respectively, and pin bases 28 at the outer ends of the pins which position the pins axially relative to the inserts. When the mold plates 18, 20 are closed to their molding positions of FIG. 2, the adjacent inner ends of the mold inserts 22 and the adjacent sides of the mold plates abut one another.

The adjacent inner ends of the mold pins 26*a*, 26*b* have mold faces 30*a*, 30*b*. When the mold plates 18, 20 are closes to their molding positions, these mold faces define an intervening mold cavity 32. In the particular embodiment shown, mold face 30*a* is concave and mold face 30*b* is flat and the mold is a plano-convex cavity for forming a plano-convex lens. During a molding operation, plastic material is fed to the cavity 32 under pressure through an injection sprue 34 and a runner 36. An ejector pin 38 is provided for ejecting the molded lens from the mold cavity when the mold plates 18, 20 are opened.

Except for the mold pins 26*a*, 26*b*, the injection mold described above is conventional. The present invention is concerned only with and provides an improved method for making the mold pins 26*a*, 26*b*. This method will now be described by reference to FIGS. 4–7.

The first step of the method involves forming a cylindrical slug 39 (actually several slugs) from a roll formed bar or rod 40 of high grade steel, such as UDDELHOLM STAVAX 420 ESR steel produced by the UDDELHOLM Corp. These slugs are then processed as described below to form mold pins. As noted earlier and depicted in FIG. 4, during roll forming of a steel rod, impurities 42 in the steel are driven toward the center of rod. As a consequence, the finished rod has a central longitudinally extending region 44 with a relatively high concentration of impurities 42 surrounded by an outer annular region 46 with a very much lower impurity concentration.

Figure 4:
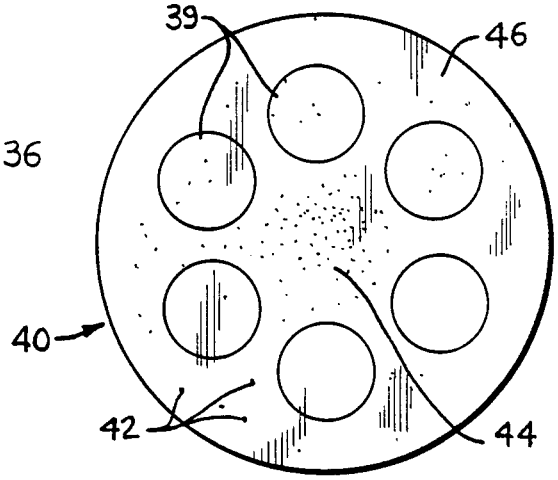
FIGS. 4, 4*a*, 5, 6, 6*a* and 7 depict successive mold pin fabricating steps according to the invention.
Figure 4A:
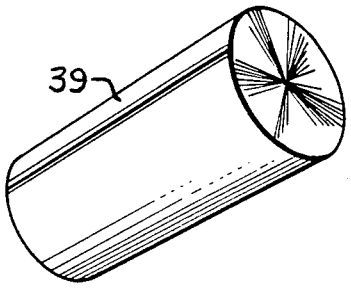
Figure 5:
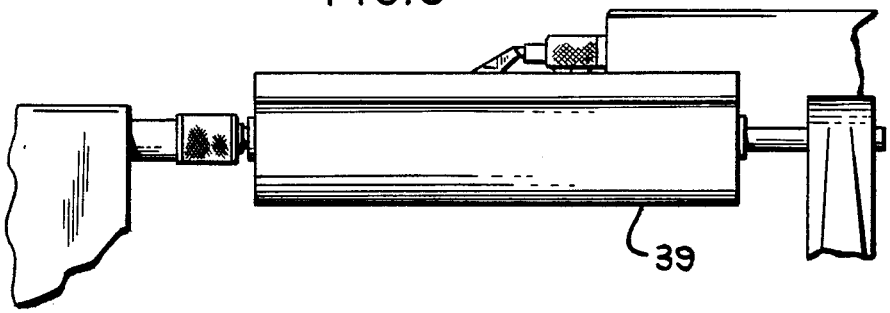
Figure 7:
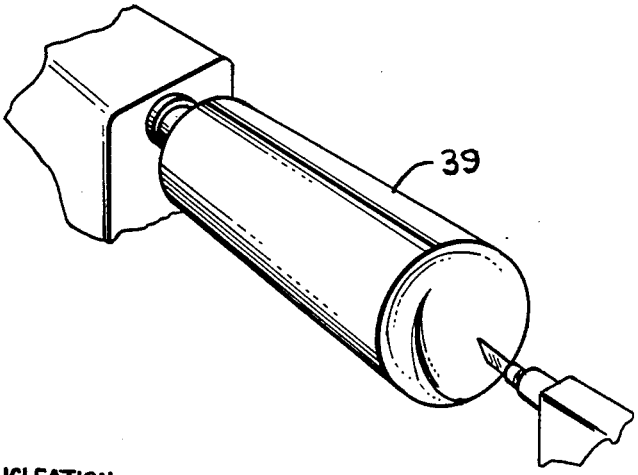

According to the present invention the steel rod used for making the mold pins 26*a*, 26*b* is selected to have a diameter such that the radial dimension of its relatively impurity free annular region 46 is substantially greater than the desired pin diameter. By way of example, the diameter of the steel rod 40 for making mold pins on the order of $\frac{5}{8}$ to $\frac{3}{4}$ inches in diameter may be 2-$\frac{1}{2}$ inches. The slugs 39 are then cut from the relatively impurity free annular region 46 of the rod, as by coring the rod axially through the annular region, as shown in FIG. 4. The slug diameter and length will be slightly greater than the desired diameter and length of the finished mold pin This method of forming the mold pin slugs 39 results in a slug having on the order of 90% fewer impurities than a pin slug formed by the conventional method described earlier. The pin slug 39 may be rough turned to a diameter on the order of 0.015 inches larger than the desired diameter of the finished mold pin, as depicted in FIG. 5.

The second step of the present mold pin forming method involves heat treating the slug 39 in a corrosion resisting atmosphere, such as a carbon dioxide atmosphere. A carbon dioxide atmosphere may be conveniently provided by wrapping the slug in brown wrapping paper and then sealing the wrapped slug in 300 series stainless steel foil to form a sealed envelope in which the slug remains during the entire heat treat program. This envelope is depicted at 48 in FIG. 6 and the corrosion resisting atmosphere is depicted at 50.

Figure 6:
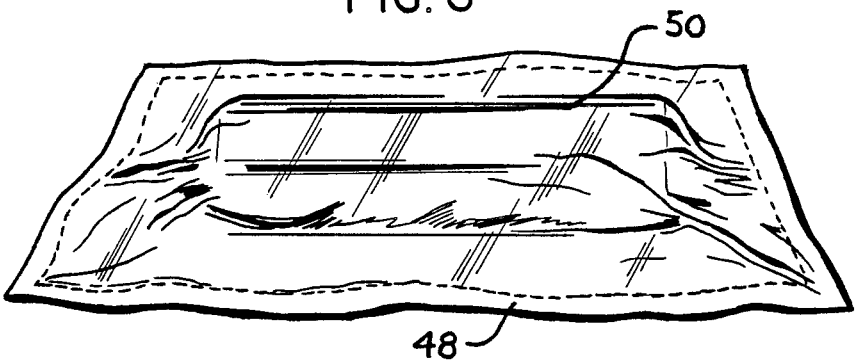
Figure 6A:
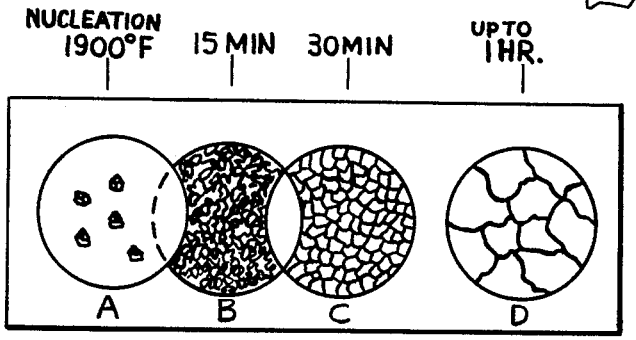

The initial steps of the heat treatment are performed in a manner to heat the slug 39 in its sealed envelope 48 to a point of dendritic crystal formation in the steel of the slug between nucleation (stage A of FIG. 6*a*) and the onset of dendritic crystal growth (stage B of FIG. 6*a*). Crystal or grain growth would normally continue through stages C and D in FIG. 6*a* if heating of the slug were allowed to continue.

According to the preferred heat treatment program of the invention, the above initial steps involve preheating the wrapped and sealed slug for about three hours at a temperature on the order of 1375° F. During this preheating, the brown paper wrapping about the slug, if used, will char to produce a carbon dioxide atmosphere 50 within the sealed envelope 48. Other suitable corrosion resisting atmospheres may be used, of course, and these atmospheres may be provided about the slug in other ways than by sealing the slug in foil. Immediately after preheating the slug as described above, the temperature is raised to a range about 1875 to 1925° F. This is preferably done quickly, as by setting the heat treatment furnace at, say, 1975° F. and then lowering the temperature to 1900° F. The required soak time at the elevated temperature to bring the slug 39 to the desired point between nucleation (stage A FIG. 6*a*) and the onset of dedritic crystal growth (stage B FIG. 6*a*) is on the order of 15 minutes.

Following heating of the slug 39 in the manner described above, it is quenched and thermally drawn while in its corrosion resisting atmosphere to harden the slug to the desired hardness. According to the preferred practice of the invention, quenching of the slug is accomplished by directing an air blast against the slug envelope 48 to cool the slug to a temperature in the range from about 150° F. to about 190° F. The quenched slug in its envelope is then placed in a draw oven and drawn at a temperature of about 450° F. for about 2 ½ hours after which the slug is cooled to room temperature. This drawing cycle (i.e. drawing at 450° F. followed by cooling to room temperature) is repeated, preferably about three times, until the slug reaches the desired hardness, which is about 45/52 on the Rockwell "C" scale.

In actual practice of the invention, a number of slugs 39, such as eight or more slugs, may be heat treated together in the same envelope 48. In this case, it may be desirable to check the hardness of only selected slugs rather than the hardness of all the slugs in order to save time.

After heat treatment to the desired hardness, the slug 39 is ground and polished to the desired outside diameter. According to the preferred practice of the invention, the slug is ground in a centerless grinder and then lapped or honed to the final diameter. Honing can be conveniently performed using a suitable lapping compound and a tungsten carbide block which contains a pin sizing bore and is split in a plane containing the axis of the bore. Using this procedure, a slug can be sized and rounded with an accuracy of $25\times100^{-6}$ inches as compared to the industry standard of $100\times10^{-6}$ inches.

Figure 3:
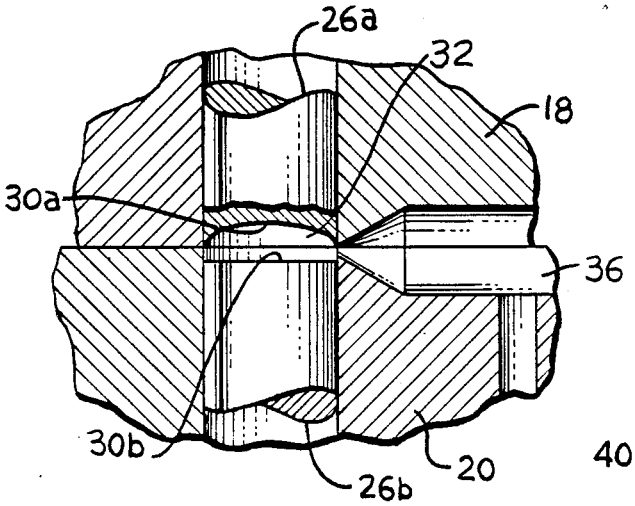
FIG. 3 is a fragmentary enlarged view of a portion of FIG. 2.

The final step of the pin fabricating method involves forming the mold face on the sized slug 39 to complete the mold pin fabrication. As noted earlier, the mold face contour depends on the lens shape to be molded. The mold pins 26*a*, 26*b* in FIGS. 2 and 3 have concave and planar mold faces, respectively, for molding a plano-convex lens.

According to the preferred practice of the invention, the mold faces are formed with a rotary cutting action about the pin axis, such as a lathe turning operation, using a cutting tool that produces a built up edge before the tool and relatively high contact pressure against the pin in such manner the cutting action reorients the grains at the mold face in a circular direction about the pin axis. The rotary cutting action and high pressure are also effective to collapse pipes and pits in the mold face with a high degree of effectiveness. If desirable or necessary, additional burnishing or polishing of the mold face may be performed to obtain a more precise and pit free face.

As noted earlier, the method of the invention produces a highly superior mold face on the mold pin. This face has substantially fewer and smaller pits than do mold pin faces produced by the existing pin fabricating procedures.

I claim:

1. In the method of forming a mold pin for a high quality mold, the steps comprising:

selecting a steel rod formed by a rolling process which drives any impurities in the rod toward its center, whereby the rod has a longitudinally extending central region having a relatively high concentration of such impurities and an annular region surrounding said central region having a relatively low concentration of said impurities, and cutting from said annular region a steel slug which is relatively free of said impurities and may be further processed to form said pin.

2. The method of claim 1, wherein:

said rod is selected to have an annular region whose radial dimension is substantially larger than the desired cross-sectional dimension of said slug.

3. The method of claim 1, wherein:

said cutting step comprises longitudinally coring a cylindrical slug from said annular region.

4. The method of claim 3, wherein:

said pin is a pin insert for an optical quality mold, and said steel is a high-grade steel made by a process involving vacuum degassing and electro-slag refining.

5. In the method of forming a mold pin for a high quality mold, the steps comprising:

selecting a steel rod formed by a rolling process which drives any impurities in the rod toward its center, whereby the rod has a longitudinally extending central region having a relatively high concentration of such impurities and an annular region surrounding said central region having a relatively low concentration of said impurities, cutting from said annular region a steel slug which is relatively free of said impurities and may be further processed to form said pin, and heating said slug in a corrosion inhibiting atmosphere to a point of dendritic crystal formation in the steel of the slug between nucleation and the onset of dendritic crystal growth and thereafter quenching and thermally drawing the slug to the desired hardness.

6. The method according to claim 5, wherein:

said heating step comprises preheating the slug in a carbon dioxide atmosphere at a temperature about 1375° F. for about 3 hours and immediately thereafter raising the temperature to about the range of 1875° F. to 1925° F. for about ¼ hour, said quenching step comprises cooling the slug while in said carbon dioxide atmosphere to a temperature in the range of about 150° F. to 190° F., and said drawing step comprises heating the quenched slug at a temperature of about 450° F. for about 2 ½ hours three times in succession and cooling the slug to room temperature between each heating cycle.

7. In the method of forming a mold pin for a high quality mold, the steps comprising:

selecting a steel rod formed by a rolling process which drives any impurities in the rod toward its center, whereby the rod has a longitudinally extending central region having a relatively high concentration of such impurities and an annular region surrounding said central region having a relatively low concentration of said impurities, longitudinally coring a cylindrical slug from said annular region, heating said slug in a corrosion inhibiting atmosphere to a point of dendritic crystal formation in the steel of the slug between nucleation and the onset of dendritic crystal growth and thereafter quenching and thermally drawing the slug to the desired hardness, and machining and polishing the slug to the desired outside diameter.

8. A mold pin made by the method of claim 7.

9. The method of claim 7, wherein:

said heating step comprises preheating the slug in a carbon dioxide atmosphere at a temperature about 1375° F. for about 3 hours and immediately thereafter raising the temperature to about the range of 1875° F. to 1925° F. for about ¼ hour, said quenching step comprises cooling the slug while in said carbon dioxide atmosphere to a temperature in the range of about 150° F. to 190° F., said drawing step comprises heating the quenched slug at a temperature of about 450° F. for about 2 ½ hours three times in succession and cooling the slug to room temperature between each heating cycle, and said machining and polishing steps comprise grinding the slug and then honing the ground slug.

10. The method of claim 7, including the additional step of:

forming a mold face at one end of said slug to form a finished mold insert pin whose grain structure at said mold face is circularly oriented about the pin axis.

11. The method of claim 10, wherein:

said mold face is an optical quality mold face formed by a rotary cutting action using a cutting tool that produces a built-up edge before the tool and thereby exerts very high pressure on the slug which re-orients the grains of the slug to a circular direction and produces a polishing area of substantial depth.

12. A mold pin made by the method of claim 10.

13. A mold pin comprising:

a cylindrical steel body having a longitudinal axis, a mold face at one end of said body, and a metallic grain structure at said face, and the metallic grain structure at said face being oriented generally circularly about the longitudinally axis of said body.

* * * * *